US010195652B2

(12) United States Patent
Calcoen et al.

(10) Patent No.: US 10,195,652 B2
(45) Date of Patent: Feb. 5, 2019

(54) METHOD FOR CHANGING THE CONFIGURATION OF A ROLLING MILL AND ROLLING MILL FOR THE IMPLEMENTATION OF SAID METHOD

(71) Applicant: FIVES DMS, Noyelles-les-Seclin (FR)

(72) Inventors: Olivier Calcoen, Seclin (FR); Conrad Ernst De La Graete, Seclin (FR); Mikael Vincendeau, Seclin (FR)

(73) Assignee: FIVES DMS, Noyelles-les-Seclin (FR)

( * ) Notice: Subject to any disclaimer, the term of this patent is extended or adjusted under 35 U.S.C. 154(b) by 519 days.

(21) Appl. No.: 14/894,263

(22) PCT Filed: May 27, 2014

(86) PCT No.: PCT/FR2014/051232

§ 371 (c)(1),
(2) Date: Nov. 25, 2015

(87) PCT Pub. No.: WO2014/191671

PCT Pub. Date: Dec. 4, 2014

(65) Prior Publication Data

US 2016/0107212 A1 Apr. 21, 2016

(30) Foreign Application Priority Data

May 28, 2013 (FR) ..... 13 54824

(51) Int. Cl.
*B21B 13/00* (2006.01)
*B21B 29/00* (2006.01)
(Continued)

(52) U.S. Cl.
CPC ..... *B21B 13/00* (2013.01); *B21B 29/00* (2013.01); *B21B 31/08* (2013.01); *B21B 2013/028* (2013.01)

(58) Field of Classification Search
CPC ..... B21B 31/10; B21B 31/08; B21B 29/00; B21B 13/02; B21B 13/001; B21B 13/00; B21B 2013/025; B21B 2013/028
See application file for complete search history.

(56) References Cited

U.S. PATENT DOCUMENTS 4,311,030 A 1/1982 Kitashima et al.
4,543,810 A 10/1985 Stoy et al.
(Continued)

FOREIGN PATENT DOCUMENTS

EP 0 059 417 A1 9/1982
EP 0 543 014 B1 5/1993
(Continued)

OTHER PUBLICATIONS

International Search Report, dated Sep. 19, 2014, from corresponding PCT Application.

*Primary Examiner* — Pradeep C Battula
(74) *Attorney, Agent, or Firm* — Young & Thompson

(57) ABSTRACT

A method for changing the configuration of a rolling mill of the six-high type in which the rolling mill is changed from a first configuration (C1) of a range of diameters of working cylinders (3', 4'), keeping the chocks (E1, E2) by turning over the chocks (E2) of the intermediate cylinders (5, 6) and by turning over the chocks (E1) of the working cylinders. A rolling mill as such, suitable for implementing the method is also described.

15 Claims, 3 Drawing Sheets

(51) Int. Cl.
*B21B 31/08* (2006.01)
*B21B 13/02* (2006.01)

(56) References Cited

U.S. PATENT DOCUMENTS

| | | | | |
|---|---|---|---|---|
| 7,302,820 | B2 * | 12/2007 | Le Viavant | B21B 13/001 72/237 |
| 9,120,134 | B2 * | 9/2015 | Guo | B21B 29/00 |
| 2006/0196243 | A1 | 9/2006 | Le Viavant | |
| 2013/0104617 | A1 | 5/2013 | Guo et al. | |

FOREIGN PATENT DOCUMENTS

| | | | |
|---|---|---|---|
| FR | 2 851 942 | A1 | 9/2004 |
| JP | S60-206508 | A | 10/1985 |
| JP | H02-280910 | A | 11/1990 |

* cited by examiner

METHOD FOR CHANGING THE CONFIGURATION OF A ROLLING MILL AND ROLLING MILL FOR THE IMPLEMENTATION OF SAID METHOD

The subject matter of the invention is a method for changing the configuration of a rolling mill, as well as a rolling mill for implementing the method.

The field of the invention is more particularly that of six-high rolling mills.

These six-high rolling mills find a particular application for example in annealing lines, or galvanisation lines or off-line rolling mills, reversible or non-reversible, for metallic strip.

The rolling mill according to the invention finds a particular application, in particular after annealing of the strip, for effecting a skin pass, very often for the purpose of eliminating the resilient level from the metallic strip, imparting roughness thereto and/or improving the brightness and/or flatness thereof.

A four-high rolling mill comprises a holding cage in which four cylinders are provided with parallel axes, namely respectively two working cylinders, top and bottom, defining the passage air gap for the strip to be rolled, and two supporting cylinders, top and bottom, bearing respectively on the working cylinders on the side opposite to that of the passage air gap.

A six-high rolling mill comprises two additional cylinders compared with a four-high, namely two intermediate cylinders interposed respectively between each working cylinder and the corresponding support cylinder.

In such rolling mills, each support cylinder, intermediate or working, is mounted so as to rotate at the ends thereof on chocks, by means of bearings, for example roller bearings or hydrostatic bearings. These chocks are supports that can be moved in a direction parallel to the gripping plane, between the two uprights of the cage.

Conventionally, first balancing actuators move the chocks of the working cylinders and second balancing actuators move the chocks of the intermediate cylinders. These balancing actuators make it possible to change the relative positions of the chocks and their cylinder, making it possible among other things to open the cage in order to facilitate the engagement of the product to be rolled, or to move these components in order to facilitate the removal of the cylinders. These balancing actuators may also make it possible to camber the cylinders, as developed hereinafter.

One advantage of a six-high rolling mill is the possibility of using, compared with a four-high cage, working cylinders with a smaller diameter, which makes it possible to obtain a greater reduction in thickness of the product to be rolled for the same rolling force.

A six-high rolling mill moreover offers the possibility of axially offsetting the two intermediate cylinders, or even also the two working cylinders, for the purpose of applying the rolling force only over the width of the strip to be rolled rather than over the entire length of the working cylinders. Such a possibility of axial adjustment of the cylinders, as in particular taught in the document U.S. Pat. No. 4,311,030, makes it possible to obtain better flatness of the product to be rolled, in particular at the edges of the rolled strip.

Since the rolling forces are applied only at the ends of the cylinders, each cylinder can flex under the action of the rolling forces, which very often results in unevenness of the strip.

Correcting these defects by applying cambering forces on the two ends of each of the working cylinders and/or on the two ends of each of the intermediate cylinders is then known.

For this purpose, it is possible to use the previously described balancing actuators to separate the chocks of the two working cylinders, thus achieving a positive camber. Some equipment also makes it possible to tighten the chocks of two working cylinders, thus achieving a negative camber. Alternatively or additionally, a positive and/or negative camber can also be provided on the intermediate cylinders.

A six-high rolling cage comprising, in a conventional manner, two working cylinders, two intermediate cylinders and two support cylinders is thus known from the prior art, in particular from the document EP 0 059 417.

In the rolling cage of the type in the document EP 0 059 417, the balancing actuators are double-acting hydraulic actuators and do not act directly on the chocks of the cylinders, but only by means of cambering units, each mounted so as to slide along a rail disposed over the height of one of the uprights of the cage. The movement of the working cylinders or intermediate cylinders, along the gripping plane, is obtained by sliding the corresponding cambering units with respect to the upright of the cage.

In such a rolling mill, the axial movement of the working cylinders, or the axial movement of the intermediate cylinders, can be obtained by sliding their respective chocks with respect to the corresponding cambering units. To this end, the chocks have guide parts oriented in a direction parallel to the axes of the cylinders, for example two horizontal tenons, projecting laterally on each side of the chock, able to slide respectively in corresponding parts of the corresponding two cambering units, for example in horizontal grooves in the two corresponding units.

Such a design is simple and can advantageously make it possible, using asymmetric chocks, to mount, in the same cage, two different cylinder diameter ranges, for the working cylinders and for the intermediate cylinders, simply by turning over the chocks. The change from one cylinder diameter configuration to the other configuration is therefore obtained by keeping the asymmetric chocks of the intermediate cylinders and the asymmetric chocks of the working cylinders.

These chocks are asymmetric in that the guide parts of the chocks are offset in a direction parallel to the gripping plane, with respect to the axis of the corresponding cylinder, which makes it possible, when the chocks of the working cylinders and the chocks of the intermediate cylinders are turned through 180°, to change the position of the rotation axis of the chocks.

The change in configuration is thus obtained by keeping the same rolling mill cage, the same camber force application means (ie the same cambering units) for the working cylinders and for the intermediate cylinders, and the same chocks for the working cylinders and for the intermediate cylinders.

Such a change in configuration of the cage makes it possible to extend the production range of a rolling installation and to make this equipment, which keeps a maximum amount of equipment from one configuration to another, profitable more quickly.

A rolling mill cage according to the document EP 0 059 417 does however have certain drawbacks.

First of all this cage uses, for the balancing actuators, units for cambering the double-acting hydraulic actuators that give rise to clearances, in particular when the direction of camber is reversed, namely from a positive camber to a negative camber, or vice versa. These double-acting hydraulic actuators create discontinuities of functioning, which may be particularly detrimental during certain productions.

In addition, and in accordance with the findings of the inventors, the balancing actuators do not act directly on the cylinder chocks, but only by means of said cambering units, themselves mounted so as to slide each by means of a rail or equivalent along the cage uprights.

According to the findings of the inventor, these cambering units are liable to create high friction, which will be greatly accentuated during the axial movements of the intermediate cylinders and/or working cylinders, traditionally made to apply the rolling force only over the width of the strip to be rolled.

This is because these axial movements are obtained by movement of the chocks with respect to the cambering units. During such movements, the vertical forces transmitted by each chock to the corresponding cambering unit are no longer centred along the axis of said corresponding cambering unit, but on the contrary greatly offset with respect to this. Such an offset causes a tilting force on the cambering unit, giving rise to an increase in friction between the unit and the upright. Naturally such friction disturbs the precision of the control of the cambering forces to be applied.

In order to limit this defect, for a design of rolling mill with cambering units according to the document EP 0 059 417, limiting the magnitude of the axial movements of the cylinders to ±160 mm is known, which generally makes it necessary to use, for the working cylinders and the intermediate cylinders, particular profiles, in the shape of bottles, for the cylinders, as taught by the document EP 0 543 014 B1, also known by the term "Continuous Variable Crown" (CVC). With traditional cylinder profiles typically comprising a cylindrical length section followed by a conical length section, the axial movement of travel necessary becomes too great and this design with cambering units is often considered to be unsuitable.

Four-high rolling mill cages able to use, in the same cage, two different working cylinder diameter ranges, while keeping the same chocks, are also known from the prior art. Such a change in configuration of the cage makes it possible to extend the production range of a rolling installation and to make this equipment profitable more quickly, which keeps a maximum amount of equipment from one configuration to another.

In this prior art, the chocks have parallel sliding faces on either side of the gripping plane, intended to cooperate with guide faces of the windows oriented in the gripping direction. Each chock has, on each side, laterally, a projecting tenon intended to serve as a support for single-acting balancing actuators, functioning solely under thrust. Some of the balancing actuators are provided below the tenon and act so as to thrust on the bottom face of the tenon of the chocks in order to camber the corresponding working cylinder in a first cambering direction. The other single-acting actuators are provided on the other side of the tenon, above the tenon, and act so as to thrust on the top face of the tenon of the chocks in order to camber the working cylinder in the other direction.

Such a design using only single-action balancing actuators to camber the cylinders, in one direction or the other, does not create any discontinuity during the reversal of the cambering direction.

The chocks are asymmetric, the tenons of the chocks of each working cylinder being offset with respect to the axis of the cylinder, in a direction parallel to the gripping plane. The change in configuration is effected by turning the chocks of the working cylinders through 180° in order to pass from one diameter range to another working cylinder range.

In such a design of a four-high rolling mill, and in accordance with the findings of the inventors, the single-acting balancing actuators cooperating with the same chock are disposed on either side of the chock tenons and thus occupy an excessively great vertical space for such a design to be able to be duplicated at a rolling mill cage of the six-high type.

Duplicating such an arrangement of balancing actuators for the chocks of the working cylinders and another additional arrangement of balancing actuators for the chocks of the intermediate cylinders is not possible because of the vertical bulk of the solution, greater than the space available in a cage of the six-high type.

The aim of the present invention is to overcome the aforementioned drawbacks by proposing a method for changing the configuration of a rolling mill of the six-high type from one working cylinder diameter range to another distinct range. The invention makes it possible to pass from one configuration to another while keeping in particular the same chocks, the same cambering means, and the same support cylinders, and optionally the same intermediate cylinders.

The invention also concerns a rolling mill suitable for implementing the method, with an improved performance compared with the prior art such as rolling mills with cylinders interchangeable by turning over chocks, in particular on the aspects of controlling the camber forces, or with regard to the possible magnitudes of axial movement of the intermediate cylinders.

Other aims and advantages will emerge from the description, which is given only by way of non-limitative example.

Thus the invention concerns first of all a method for changing the configuration of a rolling mill comprising:

- a holding cage,
- a set of cylinders placed one above the other, with substantially parallel axes, comprising two working cylinders, bottom and top, two intermediate cylinders, bottom and top, and two support cylinders, respectively bottom and top,
- each cylinder having two ends mounted so as to rotate, each on a bearing carried by a chock,
- means for applying a clamping force between the chocks of the support cylinders,
- means for applying vertical camber forces on the working cylinders, comprising two sets of hydraulic actuators,
- means for applying vertical camber forces on the intermediate cylinders, comprising two sets of hydraulic actuators,
- a method in which the chocks of the working cylinders and the chocks of the intermediate cylinders are asymmetric and in which the rolling mill is changed from a first working cylinder diameter range configuration to a second configuration with different working cylinder diameters while keeping the chocks, by turning over the chocks of the working cylinders and turning over the chocks of the intermediate cylinders, while keeping the same cage, the same means for applying a clamping force between the chocks of the support cylinders, the same means for applying vertical camber forces on the working cylinders, the same means for applying vertical camber forces on the intermediate cylinders, and the same type of support cylinder.

According to the method in accordance with the invention:

for the chocks of the working cylinders and for the chocks of the intermediate cylinders, use is made of supports comprising four support members, disposed laterally, with firstly two support members projecting on one side of the chock, namely a top support member and a bottom support member defining a first interspace, and secondly two support members projecting on the other side of the chock, namely a top support member and a bottom support member defining a second interspace, the hydraulic actuators of the means for applying vertical camber forces on the working cylinders are actuators disposed in the first and second interspaces of the chocks of the working cylinders, the actuators disposed in one and the same interspace being overlapping, the actuators being intended to cooperate thrustingly, in some cases, with the top support members in order to camber the working cylinder in a first direction and for the remainder with the bottom support members in order to camber the working cylinder in the other direction, the hydraulic actuators of the means for applying vertical camber forces on the intermediate cylinders are actuators disposed in the first and second interspaces of the chocks of the intermediate cylinders, the actuators disposed in one and the same interspace being overlapping, said actuators being intended to cooperate thrustingly, in some cases, with the top support members order to camber the intermediate cylinder in a first direction and for the remainder with the bottom support members in order the camber the intermediate cylinder in the other direction, According to an advantageous embodiment, the same intermediate cylinders are kept from the first configuration of the rolling mill to the second configuration.

Alternatively, it is also possible to change intermediate cylinder diameter from the first configuration of the rolling mill to the second configuration.

According to optional features of the method according the invention, taken alone or in combination:

the first configuration of the rolling mill enables working cylinders to be mounted with a diameter between 800 mm and 500 mm and the second configuration of the rolling mill enables a working cylinder to be mounted with a diameter of between 500 mm and 250 mm;

said rolling mill comprises means for adjusting the axial movement of the intermediate cylinders and in which these means comprise supports mounted slidably with respect to the cage, the supports taking the hydraulic actuators of said means for applying vertical camber forces on the intermediate cylinders to as to obtain the axial movement of the intermediate cylinders without relative movement between the chocks and said hydraulic actuators;

identical chocks are used for the working cylinders, top and bottom, and identical chocks for the intermediate cylinders, top and bottom;

the rods of the actuators of said means for applying vertical camber forces on the working cylinders and/or on the intermediate cylinders are intended to be in simple abutment on said support member;

the chocks of the working cylinders and of the intermediate cylinders have sliding faces intended to cooperate with guide faces of the cage and in which, preferably, the sliding faces of the chocks of the working cylinders and/or of the intermediate cylinders are situated at the ends of the support members.

The invention also concerns a rolling mill as such, suitable for implementing the method, comprising:

a holding cage, a set of cylinders placed one above the other, with substantially parallel axes, comprising two working cylinders, bottom and top, two intermediate cylinders, bottom and top, and two support cylinders, respectively bottom and top, each cylinder having two ends mounted so as to rotate, each on a bearing carried by a chock, means for applying a clamping force between the chocks of the support cylinders, means for applying vertical camber forces on the working cylinders, comprising two sets of hydraulic actuators, means for applying vertical camber forces on the intermediate cylinders, comprising two sets of hydraulic actuators.

According to the rolling mill in accordance with the invention:

the chocks of the working cylinders and the chocks of the intermediate cylinders are supports comprising four support members, disposed laterally, with firstly two support members projecting on one side of the chock, namely a top support member and a bottom support member defining a first interspace, and secondly two support members projecting on the other side of the chock, namely a top support member and a bottom support member defining a second interspace, the hydraulic actuators of the means for applying vertical camber forces on the working cylinders are actuators disposed in the first and second interspaces of the chocks of the working cylinders, the actuators disposed in one and the same interspace being overlapping, said actuators being intended to cooperate thrustingly, in some cases, with the top support members order to camber the working cylinder in a first direction and for the remainder with the bottom support members in order to camber the working cylinder in the other direction, the hydraulic actuators of the means for applying vertical camber forces on the intermediate cylinders are actuators disposed in the first and second interspaces of the chocks of the intermediate cylinders, the actuators disposed in one and the same interspace being overlapping, the actuators being intended to cooperate thrustingly, in some cases, with the top support members in order to camber the intermediate cylinder in a first direction and for the remainder with the bottom support members in order to camber the intermediate cylinder in the other direction, the chocks of the working cylinders and the chocks of the intermediate cylinders are asymmetric chocks so as to enable the rolling mill to pass from a first working cylinder diameter range configuration to a second configuration with different working cylinder diameters while keeping the chocks, by turning over the chocks of the working cylinders and turning over the chocks of the intermediate cylinders, keeping the same cage, the same means of applying a clamping force between the chocks of the support cylinders, the same means of applying vertical camber forces to the working cylinders, the same means of applying vertical camber forces to the intermediate cylinders, and the same type of support cylinder.

According to an advantageous embodiment, it is possible to keep the same intermediate cylinders when the rolling mill passes from the first configuration to the second configuration.

According to optional features of the rolling mill taken alone or in combination:

- the rolling mill comprises means for adjusting the axial movement of the intermediate cylinders and these means comprise supports mounted so as to be able to slide with respect to the cage, the supports taking the hydraulic actuators of said means of applying vertical camber forces to the intermediate cylinders so that the axial movement of the intermediate cylinders is obtained without relative movement between the chocks and said hydraulic actuators;
- the rods of the actuators of said means for applying vertical camber forces to the working cylinders and/or to the intermediate cylinders are intended to be in simple abutment on said support members;
- the chocks of the working cylinders and of the intermediate cylinders have sliding faces intended to cooperate with guide faces of the cage;
- the sliding faces of the chocks of the working cylinders and/or of the intermediate cylinders are situated at the ends of the support members.

The invention will be understood better from a reading of the description accompanied by the attached figures, among which:

Figure 2:
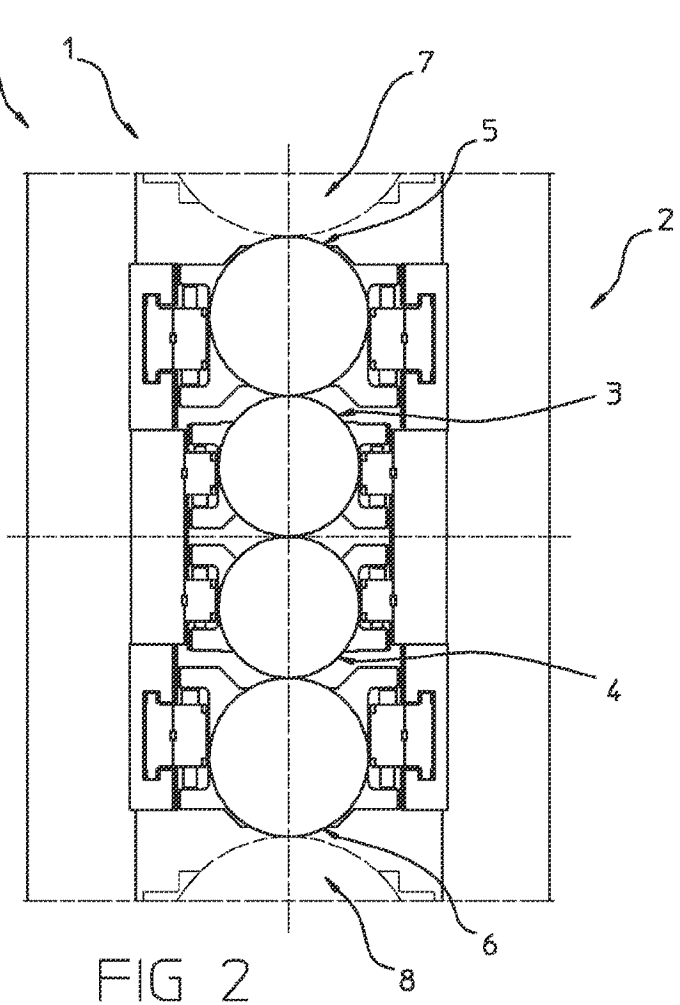
FIG. 1 and FIG. 2 are views of a rolling mill according to the invention in said first configuration of the rolling mill carrying respectively working cylinders with diameters of 570 mm (FIG. 1) and 620 mm (FIG. 2).

Thus the invention relates to a rolling mill 1 comprising a holding cage 2 having pairs of uprights 20, 21, separated from each other and disposed at the two ends of the cage. The uprights 20, 21 of each pair define between them an access window for maintenance of the cages.

The rolling mill is of the six-high type and comprises a set of cylinders above one another with substantially parallel axes, comprising two working cylinders 3, 4; 3', 4', bottom and top, two intermediate cylinders 5, 6, bottom and top, and two support cylinders 7, 8, respectively bottom and top.

The two working cylinders 3 and 4 are situated on either side of the strip to be rolled, the separation thereof defining the passage air gap in operation. Each intermediate cylinder 5 or 6 is interposed between the working cylinder 3 or 4 and the corresponding support cylinder 7 or 8.

Each working cylinder 3 or 4 has two ends mounted so as to rotate, each on a bearing P1 carried by a chock E1. Likewise, each intermediate cylinder 5 or 6 has two ends mounted so as rotate, each on a bearing P2 carried by chock E2. The support cylinders 7 or 8 also have two ends mounted so as to rotate, each mounted on a bearing carried by a chock.

The chocks E1 of the working cylinders, the chocks E2 of the intermediate cylinders and the chocks of the support cylinders 7, 8 are mounted so as to slide in a direction parallel to the gripping plane, so as to enable the cage to be opened or closed, or to facilitate the maintenance and dismantling operations.

The rolling mill has means of applying a clamping force between the chocks of the support cylinders. These means, conventionally hydraulic, are not illustrated since they are well known to persons skilled in the art.

The rolling mill 1 also comprises means 9 for applying vertical camber forces to the working cylinders 3, 4; 3', 4', comprising two sets of hydraulic actuators V1, V2, V3 and means 10 for applying vertical camber forces to the intermediate cylinders, comprising two sets of vertical actuators V 1', V2', V3'.

In accordance with the rolling mill according to the invention, the chocks E1 of the working cylinders 3, 4; 3', 4' and the chocks E2 of the intermediate cylinders 5, 6 are supports comprising four support members O1, O2, O3, O4; O1', O2', O3', O4', as illustrated in detail by way of non-limitative example in FIG. 5.

Figure 5:
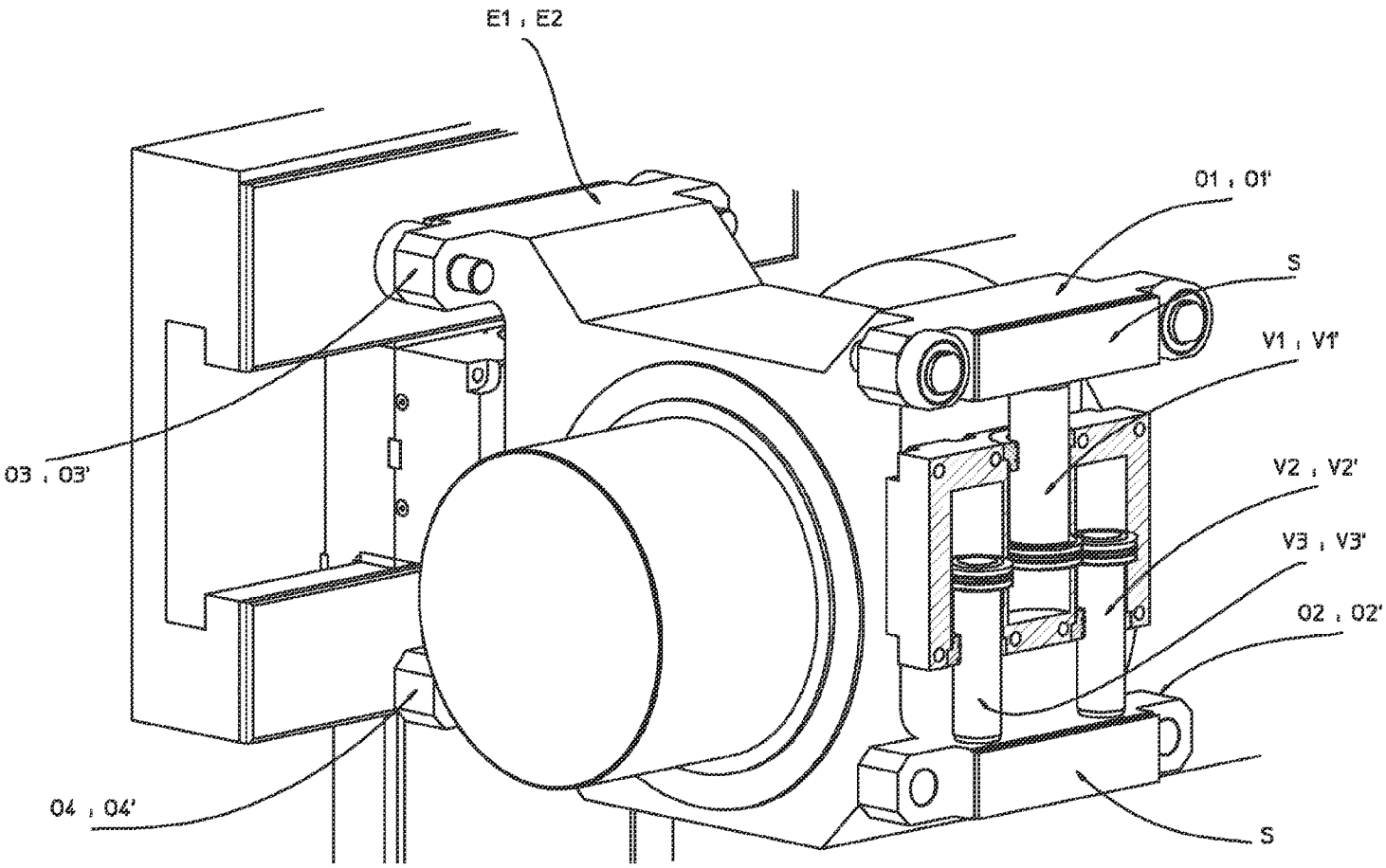
FIG. 5 is a detail view of the general form of a chock used for the working cylinders and the intermediate cylinders.

It should be noted that, for reasons of simplification, FIG. 5 illustrates the general form both of a chock E1 of the working cylinders and of a chock E2 of the intermediate cylinders. Preferably the chocks E1 of the working cylinders and the chocks E2 of the intermediate cylinders are not identical, the dimensions of the chocks E1 of the working cylinders preferably being less than those of the intermediate cylinders.

The four support members O1, O2, O3, O4; O1', O2', O3', O4' are disposed laterally to the chocks E1 or E2. Thus the chocks E1 of the working cylinders each have, firstly two support members O1, O2 projecting on one side of the chock E1, namely a top support member O1 and bottom support member O2 defining a first interspace, and secondly two support members O3, O4 projecting on the other side of the chock, namely a top support member O3 and a bottom support member O4 defining a second interspace.

Likewise the chocks E2 of the intermediate cylinders each have, firstly two support members O1', O2' projecting on one side of the chock E2, namely a top support member O1' and bottom support member O2' defining a first interspace, and secondly two support members O3', O4' projecting on the other side of the chock, namely a top support member O3' and a bottom support member O4' defining a second interspace.

The hydraulic actuators V1, V2, V3 of the means 9 for applying vertical camber forces to the working cylinders are actuators disposed in the first and second interspaces of the chocks of the working cylinders 3, 4; 3', 4'.

The actuators V1, V2, V3 disposed in the same interspace are parallel to each other and substantially overlap at least over part of their length as illustrated by way of non-limitative example in FIG. 5. In this example, and more generally, the bodies of the actuators V1, V2, V3 extend in length at the same height level and may optionally consist of the same hydraulic unit. An overlap of the actuators limits the vertical dimension of the means 9.

The actuators V1, V2, V3 are intended to cooperate thrustingly, in some cases, with the top support members O1, O3 in order to camber the working cylinders 3; 3'; 4; 4' in a first direction and with regard to the remainder with the bottom support members O2, O4 in order camber the working cylinders 3; 3'; 4; 4' in the other direction. According to an embodiment illustrated in FIG. 5, in the same interspace the rod of a actuator V1 is intended to be in simple abutment on one of the support members, bottom or top, while the rods of the other two actuators V2, V3, disposed on either side of the actuator V1, are intended to be in simple abutment on the other one of the support members, top or bottom.

Likewise, the hydraulic actuators of the means 10 for applying vertical camber forces to the intermediate cylinders 5, 6 are actuators disposed in the first and second interspaces of the chocks E2 of the intermediate cylinders.

The actuators V1', V2', V3' disposed in the same interspace are parallel to each other and overlap at least over part of their length as illustrated by way of non-limitative example in FIG. 5. In this example, and more generally, the bodies of the actuators V1', V2', V3' extend in length at the same height level and may optionally consist of the same hydraulic unit. An overlap of the actuators limits the vertical dimension of the means 10.

The actuators V1', V2', V3' are intended to cooperate thrustingly in some cases with the top support members O1', O3' in order to camber the intermediate cylinder in a first direction and with regard to the remainder with the bottom support members O2', O4' in order to camber the intermediate cylinder in the other direction.

The actuators V1, V2, V3 and/or V1', V2', V3' may be single-acting actuators. Working only thrustingly in one cambering direction or the other, they create no discontinuity when the camber direction is reversed. Moreover, the actuators V1, V2, V3 and/or V1', V2', V3' act directly on the chocks E1 or E2, and control of the camber forces is facilitated thereby.

According to an embodiment illustrated in FIG. 5, in the same interspace the rod of a actuator V1' is intended to be in simple abutment on one of the support members, top or bottom, while the rods of the other actuators V2', V3', disposed on either side of the actuator V1', are intended to be in simple abutment on the other one of the support members, top or bottom.

The chocks E1 of the working cylinders 3, 4; 3', 4' have sliding faces, on either side of the chock E1, parallel to each other, intended to cooperate with guide faces, preferably provided on the uprights of the cage.

Likewise the chocks E2 of the intermediate cylinders 5, 6 have sliding faces, on either side of the chock E2, parallel to each other, intended to cooperate with guide faces, preferably provided on the uprights of the cage. Preferably, and as illustrated in FIG. 5, the sliding faces S of the chocks E1, E2 of the working cylinders and/or of the intermediate cylinders are situated at the ends of the support members O1, O2, O3, O4; O1', O2', O3', O4'.

According to this embodiment, the sliding faces S may comprise shoes, substantially parallel to each other and to the gripping plane, fixed at the ends of the support members O1, O2, O3, O4; O1', O2', O3', O4'.

Alternatively, the guidance between the cage 2 and the chocks E1, E2 may be obtained by providing the sliding faces, laterally to the body of the chocks, at each interspace.

Figure 1:
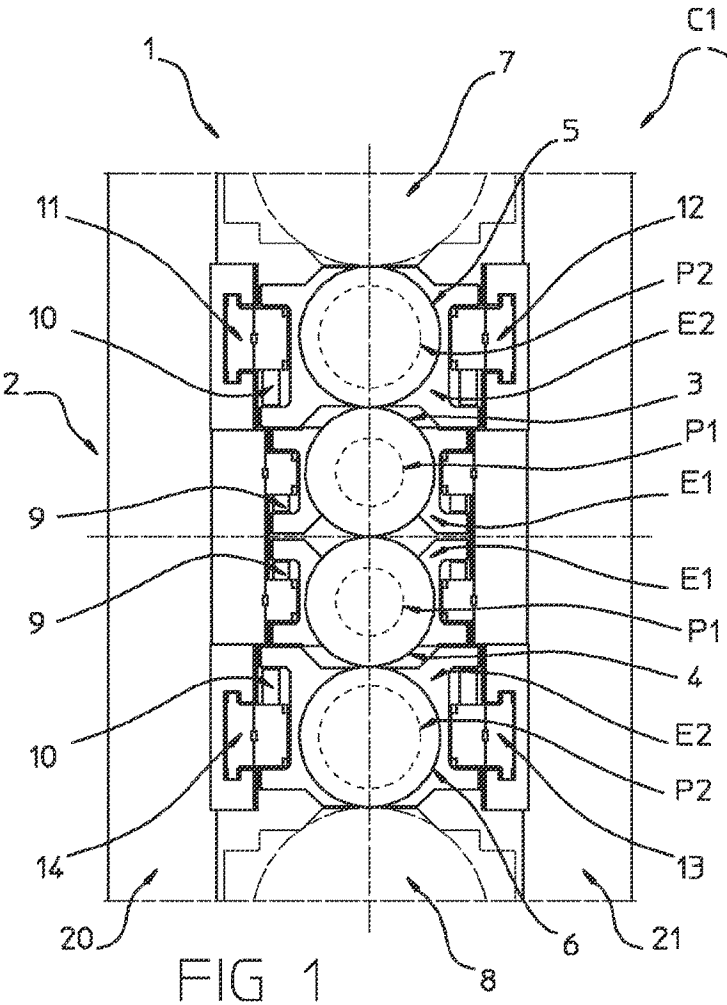
Figure 4:
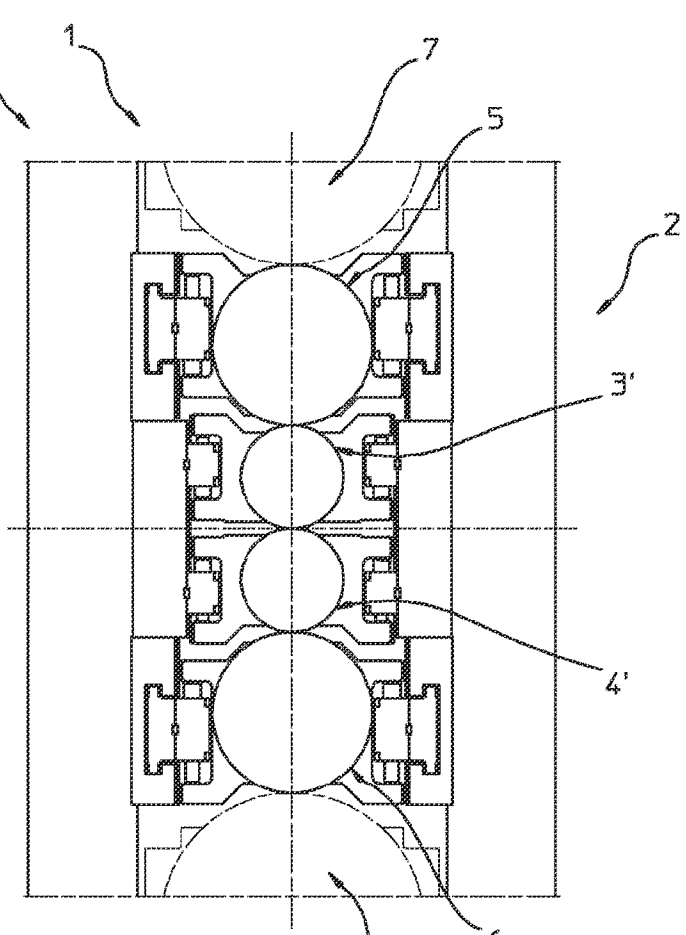
FIG. 3 and FIG. 4 are views of the rolling mill according to FIGS. 1 and 2, in which said second configuration of the rolling mill, after turning over the chocks of the working and intermediate cylinders, carry respectively working cylinders with diameters of 400 mm (FIG. 3) and 450 mm (FIG. 4).
Figure 3:
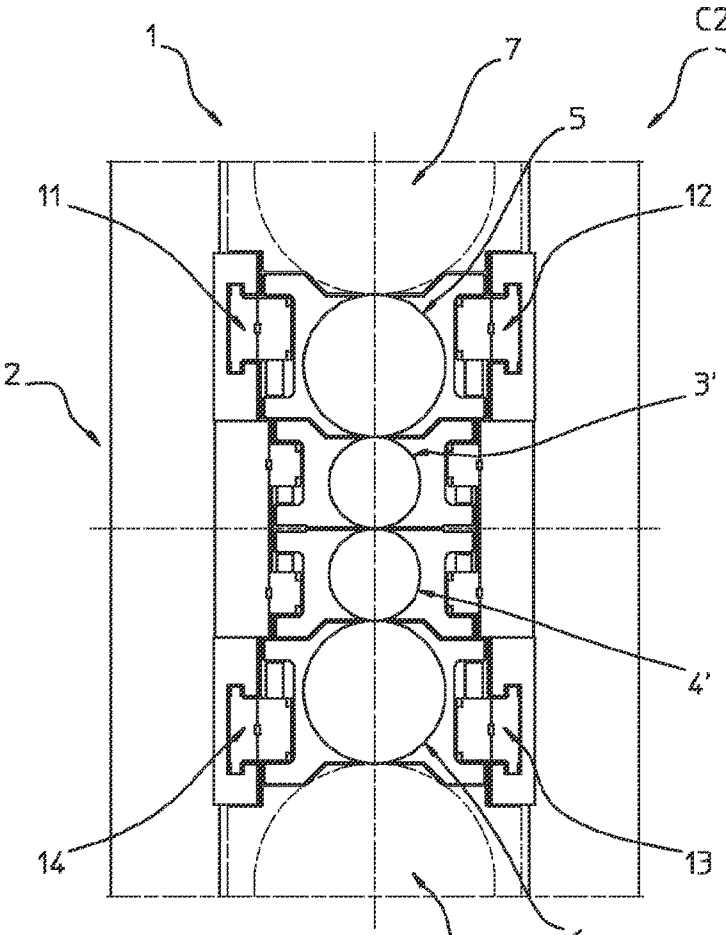

According to an essential feature of the invention, the chocks E1 of the working cylinders 3, 4; 3', 4' and the chocks E2 of the intermediate cylinders 5, 6 are asymmetric chocks so as to enable the rolling mill to pass from a first configuration of the range of diameters of working cylinders 3, 4 (see FIG. 1 or 2) to a second configuration C2 of different diameters of working cylinders 3', 4' (see FIG. 3 or 4).

Preferably the same intermediate cylinders 5, 6 are kept from the first configuration C1 to the second configuration C2 of the rolling mill. It is however possible, according to another alternative, to change intermediate cylinder diameters from the first configuration C1 to the second configuration C2.

Asymmetric means the fact that the support members O1, O2, O3, O4; O1', O2', O3', O4' of the chocks E1 or E2 are not distributed, in the direction of the uprights, at equal distances from the support axis of the cylinder of the chock E1 or E2.

By turning over the chocks E1 or E2 and making them engage with the same actuators V1, V2, V3 or V l', V2', V3', it is then possible to offset the position of the axis of the cylinder, without modifying the position of the actuators.

According to an embodiment given by way of non-limitative example, the first configuration C1 of the rolling mill 1 may make it possible to mount working cylinders with a diameter of between 800 mm and 500 mm, preferably 670 mm and 520 mm, for example between 620 mm and 570 mm, and the second configuration C2 of the rolling mill makes it possible to mount working cylinders with a diameter of between 500 mm and 250 mm, preferably between 500 mm and 350 mm, for example between 450 mm and 400 mm.

Advantageously, the change in configuration of the rolling mill is obtained by keeping the chocks E1, E2, turning over the chocks E1 of the working cylinders and turning over the chocks E2 of the intermediate cylinders, keeping the same cage 2, the same means for applying a clamping force between the chocks of the support cylinders, the same means 9 for applying vertical camber forces to the working cylinders, the same means 10 for applying vertical camber forces to the intermediate cylinders, and the same type of support cylinder 7, 8, and optionally the same intermediate cylinders 5, 6.

During this change of configuration, the cage 2, the means for applying a clamping force between the chocks of the support cylinders, the means 9 for applying vertical camber forces to the working cylinders, the means 10 for applying vertical camber forces to the intermediate cylinders, and the support cylinders 7, 8, are not removed from the rolling mill.

On the other hand, the working cylinders 3, 4 (and respectively 3', 4') are removed with their chocks E1. Once separated from the cylinders, the chocks E1 are assembled on the working cylinders 3', 4' (and respectively 3, 4) with different diameters, in the turned-over position. The new working cylinders with their turned-over chocks are mounted in the cage 2.

Likewise, the intermediate cylinders 5, 6 are removed with their chocks E2. In the case where the intermediate cylinders 5, 6 are kept, the chocks E2 are simply turned over out of the cage 2, before being mounted once again in the cage 2. In the case of a change of intermediate cylinders, with different diameters, the chocks E2 are separated from the cylinders and are assembled on the intermediate cylinders with different diameters. The new intermediate cylinders with their turned-over chocks are then mounted in the cage 2. Preferably identical chocks E1 are used for the working cylinders, top and bottom, and identical chocks E2 for the intermediate cylinders, top and bottom. The chocks E1 and/or E2 of the top cylinders are simply reversed with respect to the chocks E1 and/or E2 of the bottom cylinders.

Preferably, said rolling mill 1 comprises means for adjusting the axial movement of the intermediate cylinders. Advantageously, these means comprise supports 11, 12, 13, 14 mounted so as to slide with respect to the cage, in a direction parallel to the axis of the intermediate cylinder, the supports, 11, 12, 13, 14 taking the hydraulic actuators V1', V2', V3' of said means 10 for applying vertical camber forces to the intermediate cylinders 5, 6.

The axial adjustment of the intermediate cylinders 5, 6, in particular in order to adapt the rolling force only over the width of the strip to be rolled, is thus obtained without relative movement between the chocks E2 of the intermediate cylinders and said corresponding hydraulic actuators V1', V2', V3'. Such a design allows high axial adjustment travels greater than ±160 mm, such as for example ±250 mm, and thus allows the user of traditional intermediate cylinders having a cylindrical length section following by a conical section, or cylinders with variable profiles with different shapes since they are more progressive.

The rolling mill according to the invention and the configuration change method finds an application in lines comprising an annealing operation, such as for example galvanisation lines or continuous annealing lines, or in rolling mills outside a line, such as for example reversible rolling mills or discontinuous rolling mills.

Naturally other embodiments could have been envisaged without departing from the scope of the invention as defined by the following claims.

List of Parts

1. Rolling mill
2. Cage
3, 4. Working cylinders
3', 4'. Working cylinders
5, 6. Intermediate cylinders
7, 8. Support cylinders
9. Means for applying vertical camber forces to the working cylinders
10. Means for applying vertical camber forces to the intermediate cylinders
11, 12, 13, 14. Supports for the means for adjusting the axial movement of the intermediate cylinders
20, 21. Cage uprights
C1. First configuration
C2. Second configuration
E1. Working-cylinder chocks
E2. Intermediate-cylinder chocks
O1, O2, O3, O4. Members supporting the working-cylinder chocks
O1', O2', O3', O4'. Members supporting the intermediate-cylinder chocks
S. Sliding face of chocks (E1 or E2)
V1, V2, V3. Actuators for the means for applying vertical camber forces to the working cylinders
V1', V2', V3'. Actuators for the means for applying vertical camber forces to the intermediate cylinders

The invention claimed is:

1. A method for changing the configuration of a rolling mill the rolling mill comprising:

a holding cage;

a set of cylinders placed one above the other, with substantially parallel axes, the set of cylinders comprising:

a bottom working cylinder and a top working cylinder, a bottom intermediate cylinder and a top intermediate cylinder, and a bottom support cylinder and a top support cylinder, wherein each cylinder comprises two ends mounted so as to rotate, each on a bearing carried by a chock;

a hydraulic element that applies a clamping force between the chocks of the support cylinders;

two sets of hydraulic actuators that apply vertical camber forces on the working cylinders; and two sets of hydraulic actuators that apply vertical camber forces on the intermediate cylinders;

wherein:

the chocks of the working cylinders and the chocks of the intermediate cylinders are asymmetric;

the chocks of the working cylinders and the chocks of the intermediate cylinders, comprise supports comprising four support members disposed laterally, the four support members comprising a top support member and a bottom support member defining a first interspace, projecting on one side of the chock, and a top support member and a bottom support member defining a second interspace, projecting on an other side of the chock;

the hydraulic actuators that apply vertical camber forces on the working cylinders are disposed in the first and second interspaces of the chocks of the working cylinders, the actuators disposed in the same interspace are overlapping, said actuators that apply vertical camber forces on the working cylinders cooperate thrustingly, with the top support members in order to camber the working cylinder in a first direction and for the remainder with the bottom support members in order to camber the working cylinder in the other direction, the hydraulic actuators that apply vertical camber forces on the intermediate cylinders are actuators disposed in the first and second interspaces of the chocks of the intermediate cylinders, the actuators disposed in the same interspace are overlapping, and the actuators that apply vertical camber forces on the intermediate cylinders cooperate thrustingly, with the top support members order to camber the intermediate cylinder in a first direction and for the remainder with the bottom support members in order to camber the intermediate cylinder in the other direction;

said method comprising:

changing the rolling mill from a first configuration having a working cylinder diameter range to a second configuration having a working cylinder diameter range different from that of the first configuration while keeping the same chocks, wherein said changing comprises turning over the chocks of the working cylinders and turning over the chocks of the intermediate cylinders, while keeping the same cage, the same hydraulic element that applies a clamping force between the chocks of the support cylinders, the same hydraulic actuators that apply vertical camber forces on the working cylinders, the same hydraulic actuators that apply vertical camber forces on the intermediate cylinders, and the same type of support cylinder.

2. The method according to claim 1, in which the same intermediate cylinders are kept from the first configuration of the rolling mill to the second configuration.

3. The method according to claim 1, wherein the diameters of intermediate cylinders are changed from the first configuration of the rolling mill to the second configuration.

4. The method according to claim 1, wherein the first configuration of the rolling mill enables working cylinders with a diameter of between 800 mm and 500 mm to be mounted and a second configuration of the rolling mill enables working cylinders with a diameter between 500 mm and 250 mm to be mounted.

5. The method according to claim 1, wherein said rolling mill comprises supports that adjust the axial movement of the intermediate cylinders mounted so as to be able to slide with respect to the cage, the supports taking the hydraulic actuators that apply vertical camber forces to the intermediate cylinders so that the axial movement of the intermediate cylinders is obtained without relative movement between the chocks and said hydraulic actuators.

6. The method according to claim 1, wherein identical chocks are used for the top and bottom working cylinders, and identical chocks are used for the top and bottom intermediate cylinders.

7. The method according to claim 1, wherein rods of at least one of the actuators that apply vertical camber forces to the working cylinders and the actuators that apply vertical camber forces to the intermediate cylinders are in simple abutment on said support members.

8. The method according to claim 1, wherein the chocks of the working cylinders and of the intermediate cylinders have sliding faces that cooperate with guide faces of the cage and wherein the sliding faces of the chocks of at least one of the working cylinders and of the intermediate cylinders are situated at the ends of the support members.

9. A rolling mill comprising:

a holding cage;

a set of cylinders placed one above the other, with substantially parallel axes, the set of cylinders comprising:

a bottom working cylinder and a top working cylinder, a bottom intermediate cylinder and a top intermediate cylinder, and a bottom support cylinder and a top support cylinder, wherein each cylinder comprises two ends mounted so as to rotate, each on a bearing carried by a chock;

a hydraulic element that applies a clamping force between the chocks of the support cylinders;

two sets of hydraulic actuators that apply vertical camber forces on the working cylinders; and two sets of hydraulic actuators that apply vertical camber forces on the intermediate cylinders;

wherein:

the chocks of the working cylinders and the chocks of the intermediate cylinders comprise supports comprising four support members, disposed laterally, the four support members comprising a top support member and a bottom support member defining a first interspace, projecting on one side of the chock, and a top support member and a bottom support member defining a second interspace, projecting on an other side of the chock, the hydraulic actuators that apply vertical camber forces on the working cylinders are disposed in the first and second interspaces of the chocks of the working cylinders, the actuators disposed in the same interspace are overlapping, said actuators that apply vertical camber forces on the working cylinders cooperate thrustingly, with the top support members in order to camber the working cylinder in a first direction and for the remainder with the bottom support members in order to camber the working cylinder in the other direction, the hydraulic actuators that apply vertical camber forces on the intermediate cylinders are actuators disposed in the first and second interspaces of the chocks of the intermediate cylinders, the actuators disposed in the same interspace are overlapping, and the actuators that apply vertical camber forces on the intermediate cylinders cooperate thrustingly with the top support members order to camber the intermediate cylinder in a first direction and for the remainder with the bottom support members in order to camber the intermediate cylinder in the other direction, and the chocks of the working cylinders and the chocks of the intermediate cylinders are asymmetric chocks so as to enable the rolling mill to pass from a first configuration with one working cylinder diameter range to a second configuration having working cylinder diameters different from the working cylinder diameter range of the first configuration while keeping the same chocks of the working cylinders and the same chocks of the intermediate cylinders, by turning over the chocks of the working cylinders and turning over the chocks of the intermediate cylinders, keeping the same cage, the same hydraulic element that applies a clamping force between the chocks of the support cylinders, the same hydraulic actuators that apply vertical camber forces to the working cylinders, the sam e hydraulic actuators that apply vertical camber forces to the intermediate cylinders, and the same type of support cylinder.

10. The rolling mill according to claim 9, wherein the intermediate cylinders are kept the same when the rolling mill passes from the first configuration to the second configuration.

11. The rolling mill according to claim 10 further comprising supports that adjust axial movement of the intermediate cylinders, wherein:

said supports that adjust axial movement of the intermediate cylinders are mounted so as to be able slide with respect to the cage, and said supports that adjust axial movement of the intermediate cylinders move the hydraulic actuators that apply vertical camber forces on the intermediate cylinders, toward the intermediate cylinders, so that the axial movement of the intermediate cylinders is obtained without relative movement between the chocks and said hydraulic actuators.

12. The rolling mill according to claim 9 further comprising supports that adjust axial movement of the intermediate cylinders, wherein:

the supports that adjust axial movement of the intermediate cylinders are mounted so as to slide with respect to the cage, the supports that adjust axial movement of the intermediate cylinders taking the hydraulic actuators that apply vertical camber forces to the intermediate cylinders so that the axial movement of the intermediate cylinders is obtained without relative movement between the chocks and said hydraulic actuators.

13. The rolling mill according to claim 9, wherein rods of the actuators that apply vertical camber forces to at least one of the working cylinders and the intermediate cylinders are in simple abutment on said support members.

14. The rolling mill according to claim 9, wherein the chocks of the working cylinders and of the intermediate cylinders have sliding faces that cooperate with guide faces of the cage.

15. The rolling mill according to claim 14, wherein the sliding faces of the chocks of at least one of the working cylinders and the intermediate cylinders are situated at the ends of the support members.

* * * * *